US009896798B2

(12) United States Patent
Van Wunnik et al.

(10) Patent No.: US 9,896,798 B2
(45) **Date of Patent: *Feb. 20, 2018**

(54) ABRASION RESISTANT PRODUCT

(71) Applicant: DSM IP ASSETS B.V, Heerlen (NL)

(72) Inventors: Johanna Margaretha Van Wunnik, Echt (NL); Martin Pieter Vlasblom, Echt (NL); Christiaan Henri Peter Dirks, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 167 days.

This patent is subject to a terminal disclaimer.

(21) Appl. No.: 14/413,354

(22) PCT Filed: Jul. 15, 2013

(86) PCT No.: PCT/EP2013/064932

§ 371 (c)(1),
(2) Date: Jan. 7, 2015

(87) PCT Pub. No.: WO2014/012898

PCT Pub. Date: Jan. 23, 2014

(65) Prior Publication Data

US 2015/0152595 A1 Jun. 4, 2015

(30) Foreign Application Priority Data

Jul. 17, 2012 (EP) ..... 12176778

(51) Int. Cl.

| | |
|---|---|
| ***D07B 1/04*** | (2006.01) |
| ***B66C 1/12*** | (2006.01) |
| ***D02G 3/44*** | (2006.01) |
| *D07B 1/02* | (2006.01) |
| *D07B 5/06* | (2006.01) |

(52) U.S. Cl.

CPC ..... *D07B 1/04* (2013.01); *B66C 1/12* (2013.01); *D02G 3/44* (2013.01); *D02G 3/442* (2013.01); *D07B 1/025* (2013.01); *D07B 1/02* (2013.01); *D07B 5/06* (2013.01); *D07B 2201/102* (2013.01); *D07B 2201/1044* (2013.01); *D07B 2201/1096* (2013.01); *D07B 2201/209* (2013.01); *D07B 2201/2025* (2013.01); *D07B 2201/2057* (2013.01); *D07B 2201/2083* (2013.01); *D07B 2201/2092* (2013.01); *D07B 2201/20903* (2015.07); *D07B 2201/20907* (2015.07); *D07B 2205/205* (2013.01); *D07B 2205/2014* (2013.01); *D07B 2205/2028* (2013.01); *D07B 2205/2053* (2013.01); *D07B 2205/2096* (2013.01); *D07B 2205/301* (2013.01); *D07B 2205/3003* (2013.01); *D07B 2205/3007* (2013.01); *D07B 2401/2075* (2013.01); *D07B 2501/2061* (2013.01); *D10B 2321/0211* (2013.01)

(58) Field of Classification Search

CPC . D07B 1/025; D07B 1/04; D02G 3/44; D02G 3/442; B66C 1/12

See application file for complete search history.

(56) References Cited

U.S. PATENT DOCUMENTS

| | | | | |
|---|---|---|---|---|
| 4,413,110 | A | 11/1983 | Kavesh et al. | |
| 4,897,902 | A | 2/1990 | Kavesh et al. | |
| 2007/0269654 | A1* | 11/2007 | Veillat | D02G 3/22 428/364 |
| 2010/0192758 | A1* | 8/2010 | Clough | A01K 91/00 87/8 |
| 2011/0111200 | A1* | 5/2011 | Schneiders | D02G 3/442 428/221 |
| 2012/0021216 | A1* | 1/2012 | Veillat | D02G 3/22 428/360 |
| 2015/0337464 | A1* | 11/2015 | Marissen | D02G 3/442 428/374 |

FOREIGN PATENT DOCUMENTS

| | | |
|---|---|---|
| CN | 102066633 | 5/2011 |
| EP | 0 205 960 | 12/1986 |
| EP | 0 213 208 | 3/1987 |
| EP | 0 200 547 | 7/1991 |
| EP | 0 472 114 | 2/1992 |
| EP | 2 112 259 | 10/2009 |
| GB | 2 042 414 | 9/1980 |
| GB | 2 051 667 | 1/1981 |
| JP | 59-88969 | 5/1984 |
| WO | WO 92/22701 | 12/1992 |
| WO | WO 01/73173 | 10/2001 |
| WO | WO 2004/033774 | 4/2004 |
| WO | WO 2005/066401 | 7/2005 |
| WO | 1 699 954 | 9/2006 |
| WO | WO 2007/071310 | 6/2007 |
| WO | 2009/130001 | 10/2009 |
| WO | WO 2010/048008 | 4/2010 |

OTHER PUBLICATIONS

International Search Report for PCT/EP2013/064932 mailed Jan. 15, 2014.

T. Nakajima et al., "Advanced Fiber Spinning Technology", Society of Fiber Science & Technology, 1994, 21 pages.

Anonymous, Fact Sheet—"Dyneema (R) High-Strength, High-Modulus Polyethylene Fiber", Jan. 1, 2008, 4 pages.

W. Sondhelm, "Technical Fabric Structures—1. Woven Fabrics", Handbook of Techn Textiles, Chapter 4, 2000, 33 pages.

S. Anand, "Technical Fabric Structures—2. Knitted Fabrics", Handbook of Techn Textiles, Chapter 5, 2000, 35 pages.

P. Smith, Technical Fabric Structures—3. Nonwoven Fabrics, Handbook of Techn Textiles, Chapter 6, 2000, 22 pages.

S. Ogin, "Textile-Reinforced Composite Materials", Handbook of Techn Textiles, Chapter 11, 2000, 18 pages.

H A McKenna et al., "Handbook of Fibre Rope Technology, Passage", Jan. 1, 2004, 14 pages.

* cited by examiner

*Primary Examiner* — Shaun R Hurley

(74) *Attorney, Agent, or Firm* — Nixon & Vanderhye P.C.

(57) ABSTRACT

A product comprising a plurality of interlaced yarns wherein at least a first yarn having a tensile strength, having a value TS in N/tex, said first yarn containing a plurality of UHMWPE fibers having a titer, having a value T in den, wherein the ratio T/TS is at least 5 den.tex/N. The tensile strength is obtained by adjusting the drawing ratio or the UHMWPE filaments/fibers accordingly. The product shows resistance to abrasion. The product can be a rope or round slings, comprising a sheath/jacket comprising said first yarn.

32 Claims, No Drawings

ABRASION RESISTANT PRODUCT

This application is the U.S. national phase of International Application No. PCT/EP2013/064932 filed 15 Jul. 2013 which designated the U.S. and claims priority to EP 12176778.4 filed 17 Jul. 2012, the entire contents of each of which are hereby incorporated by reference.

The invention relates to an abrasion resistant product comprising a plurality of interlaced yarns wherein at least a first yarn has a tensile strength, having a value TS in N/tex, said yarn containing a plurality of UHMWPE fibres having a titer, having a value T in den.

Products comprising a plurality of interlaced yarns, such as ropes, slings and nets are continually developed to meet the needs of high performance applications. Such developments are mainly concerned with adapting materials used in said products and/or construction methods thereof. Plenty of data analyzing the influence of the tensile strength of yarns on various properties, e.g. abrasion resistance, of products containing thereof, showed that by increasing said strength, the abrasion resistance seems to increase also. Hence, in the field of products having abrasion resistance, in particular high end ropes and slings, a common understanding has been developed in time that the use of high tensile strength yarns, e.g. polyethylene yarns such as those known as Dyneema®, provide improved abrasion resistance.

For example EP1973830 discloses a roundsling comprising a core rope and a cover woven from SK75 1760 dtex yarn sold by DSM Dyneema® (NL), a high strength ultra-high molecular weight polyethylene (UHMWPE) yarn with a strength of about 3.5 N/tex and a fiber titer of about 2 den. Said cover is reported to give good abrasion resistance to the roundsling. Other high strength yarns and in particular high strength UHMWPE yarns having high strength and thus believed to provide abrasion resistance to products containing thereof are commercially available, for example yarns sold by companies such as Honeywell and Mitsui.

There are also alternative ways to using high strength UHMWPE yarns for improving the abrasion resistance of products, e.g. by using UHMWPE tapes as disclosed in WO2010/048008. Therein it is described that covering devices which comprise a braid or woven construction of high molecular weight polyethylene tapes may provide improved abrasion resistance.

However, using high strength yarns and in particular high strength UHMWPE yarns pose several difficulties. In a first instance, such yarns are mostly manufactured with a complicated process, during which the filaments are typically drawn to a large extent. Using high draw rates usually results in increased tensile strength of the final yarn, however, while drawing takes place, the diameter or the titer of the fibers forming the yarn may be reduced. Such thinning of the fibers during drawing may pose problems during handling of the fibers which in turn may lead to a manufacturing process that may be complex and expensive. In a second instance, high strength UHMWPE yarns containing fibers having a reduced titer may deleteriously influence the handling thereof during further processing, which in turn may lead to products containing such yarns which are also difficult and expensive to manufacture.

The aim of the invention may therefore be to provide abrasion resistance products which can be manufactured with methods less affected by the above drawbacks, said products also having at least the same abrasion resistance as the current products, e.g. those using high tenacity and low titer filament yarns. A further the aim of the invention is to provide abrasion resistant products with further optimized abrasion resistance. Another aim of the invention is to provide abrasion resistant products improved abrasion resistance properties.

The invention thus provide an abrasion resistant product comprising a plurality of interlaced yarns wherein at least a first yarn has a tensile strength, having a value TS in N/tex, said first yarn containing a plurality of UHMWPE fibres having a titer per fiber, having a value T in den, characterized in that the ratio T/TS is at least 5 den.tex/N.

It was surprisingly observed that in contrast with the common understanding in the field, the use of said first yarns improves the manufacturability of the products containing thereof while keeping the abrasion resistance of said yarns at an optimum level. It was also observed that there is no need for drawing said first yarns to a large extent in order to provide the product containing thereof with necessary abrasion resistance, which in turn may lead to an easier handling of said first yarns and to a facilitation of said products' manufacturing.

It was also observed that a surprising increase in the abrasion resistance of products was obtained when said first yarns had a T/TS ratio of at least 6 den.tex/N, preferably at least 7 den.tex/N and most preferably at least 8 den.tex/N. The T/TS ratio of the first yarn has no particular upper limit, whereas it is preferred that the ratio T/TS is at most 50 den.tex/N, more preferably at most 20 den.tex/N, even more preferably at most 15 den.tex/N, even more preferably at most 11 den.tex/N and most preferred at most 10 den.tex/N. Products comprising yarns with such preferred ratios have been found to have good abrasion resistance combined with good handling of the yarns during the production of the products.

By fiber is herein understood an elongated body, the length dimension of which is much greater than its transverse dimensions of width and thickness. The fibers may have a regular or an irregular cross-section, preferably the cross-section is substantially circular, whereby the largest transverse dimension (width) of the fiber is at most 5 times the smallest transverse direction (thickness) of the fiber. The fibers in the yarn may have continuous lengths preferably throughout the entire length of said yarn, such fibers being known in the art as filaments or continuous fibers; or discontinuous lengths with a length much shorter than the length of the yarn, such fibers being known in the art as staple fibers. Staple fibers are commonly obtained by cutting or stretch-breaking filaments, e.g. G. R. Wray, Modern composite yarn Production, Columbine Press, Manchester & London, 1960. Preferably the first yarn contains a plurality of continuous UHMWPE fibres.

In the context of the present invention the titer of a fiber is expressed in denier (den) and may be calculated from the mass (in grams) of the fiber per 9000 meters of said fiber. Typically the titer of the fiber is a measure for its linear mass density. An alternative measure for the titer of a fibers is tex representing the mass (in grams) of said fiber per 1000 meters of said fiber. In the context of the present invention, it is however preferred to determine the diameter of the fiber and use said diameter to calculate the titer (in denier) of said fiber. For example a UHMWPE fiber with a diameter of about 38 μm has a titer of about 10 den; whereas a UHMWPE fiber with a diameter of 50 μm has a titer of about 17.2 den or about 1.9 tex.

By yarn is herein understood an elongated body comprising a plurality of fibers. Said fibers may be aligned in the yarn substantially parallel to each other or the yarn may have a twist which typically improves its dimensional stability.

In the context of the present invention ultrahigh molecular weight is considered as being of a weight average molecular weight of at least 400 kg/mol. More preferably, the UHMWPE used to manufacture the UHMWPE fibers of the first yarn has an intrinsic viscosity (IV) of preferably at least 3 dl/g, more preferably at least 4 dl/g, most preferably at least 5 dl/g. Preferably the IV is at most 40 dl/g, more preferably at most 25 dl/g, more preferably at most 15 dl/g. Preferably, the UHMWPE has less than 1 side chain per 100 C atoms, more preferably less than 1 side chain per 300 C atoms.

The UHMWPE fibers of the first yarn may be manufactured according to any technique known in the art, e.g. by melt, solution or gel spinning. Preferably the UHMWPE filaments are manufactured according to a gel spinning process as described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "Advanced Fibre Spinning Technology", Ed. T. Nakajima, Woodhead Publ. Ltd (1994), ISBN 185573 182 7. To obtain the specific T/TS ratios required by the present invention, the skilled person can adjust the size, e.g. final diameter, of the spinning apertures issuing the filaments and the drawing ratios used in the above mentioned processes, e.g. using higher size spinning apertures and lowering the drawing ratios to increase the T/TS ratios.

The UHMWPE fibers of the first yarn may further contain small amounts, generally less than 5 mass %, preferably less than 3 mass % of customary additives, such as anti-oxidants, thermal stabilizers, colorants, flow promoters, etc. The UHMWPE can be a single polymer grade, but also a mixture of two or more different polyethylene grades, e.g. differing in IV or molar mass distribution, and/or type and number of co-monomers or side chains. When a mixture of UHMWPEs is used, by IV, molecular weight, molar mass or any other parameter of said UHMWPE is herein understood the average of the corresponding parameters, e.g. IV, Mw, etc., of the various UHMWPEs in said mixture.

According to a preferred embodiment of the invention, the UHMWPE fibres of the first yarn have a titer of at least 6 den, more preferably at least 9 den, even more preferably at least 12 den, most preferably at least 15 den. It was observed that such yarns may be easier to manufacture and to handle and they can be obtained with easier processes such as those mentioned hereinabove, wherein for example smaller draw ratios are used. The maximum titer of the first yarn is not particularly limited. For practical reasons a maximum titer of the first yarn may be limited to at most 200 den, more preferably at most 150 den, even more preferably 100 den and most preferably at most 50 den.

The tensile strength of a yarn is measured according to common techniques detailed further below and, unless stated differently, is reported in N/tex. Alternative units for reporting tensile strength commonly used are cN/dtex, g/den and GPa. The skilled person will be familiar with conversion between the different expressions.

In a preferred embodiment of the invention, the first yarn has a tensile strength of at least 0.6 N/tex, more preferred at least 0.8 N/tex, even more preferred 1.0 N/tex and most preferred at least 1.2 N/tex.

In another preferred embodiment of the invention, the first yarn has a tensile strength in the range of 0.5 to 2.2 N/tex, more preferably in the range of 0.8 to 2.0 N/tex and most preferably in the range of 1.0 to 1.8 N/tex.

Preferably the first yarn containing a plurality of UHMWPE fibres has a tensile strength in the range of 0.5 to 2.2 N/tex and wherein the UHMWPE fibres of the first yarn have a titer of at least 6 den, more preferably a titer of at least 9 den, even more preferred a titer of at least 12 den and most preferred a titer of at least 15 den. Further preferred are first yarns containing a plurality of UHMWPE fibres, said yarns having a tensile strength in the range of 0.8 to 2.0 N/tex and wherein the UHMWPE fibres of the yarn have a titer of at least 6 den, more preferably a titer of at least 9 den, even more preferred a titer of at least 12 den and most preferred a titer of at least 15 den. Even more preferred are first yarns containing a plurality of UHMWPE fibres, said yarns having a tensile strength in the range of 1.0 to 1.8 N/tex and wherein the UHMWPE fibres of the yarn have a titer of at least 6 den, more preferably a titer of at least 9 den, even more preferred a titer of at least 12 den and most preferred a titer of at least 15 den. Said preferred ranges may provide abrasion resistant products with further optimized abrasion resistance. Moreover, for all of the above preferred embodiments, it is preferred that the UHMWPE fibers are UHMWPE filaments.

In a preferred embodiment of the present invention, the product may further comprise a second yarn containing a plurality of high performance fibers, wherein the second yarn is different from the first yarn. The first yarn and the second yarn are preferably so combined such that said yarns can be distinguished from one another, i.e. the yarns can be separated again or at least optically distinguished from one another. Such combination can be achieved for example by twisting the yarns, e.g. using a slight twist of for example at most 2 twists per meter, preferably at most 1 twist per meter, most preferably at most 0.5 twists per meter; or by bundling the fibers of the yarns tighter together to substantially prevent the fibers of the yarns from mixing together. Preferably, by different is understood that the second yarn has a ratio of the titer of the high performance fibers to the tensile strength of the second yarn (T/TS) different form the one of the first yarn. Said difference preferably is greater than 1 den.tex/N, more preferably greater than 3 den.tex/N and most preferably greater than 5 den.tex/N. Preferably, the second yarn has a T/TS ratio lower than the T/TS ratio of the first yarn. An abrasion resistant product comprising a second yarn according to above embodiment may have an optimized strength and durability relation and provide more flexible design and manufacturing process. In a preferred embodiment of the present invention, the product comprises a hybrid yarn, said hybrid yarn comprising the first yarn and the second yarn as defined hereinabove.

The second yarn containing a plurality of high performance fibers preferably has a tensile strength of at least 2.2 N/tex, more preferably of at least 2.4 N/tex, even more preferably of at least 2.7 N/tex, most preferably of at least 3.0 N/tex. The advantage of these yarns is that they have very high tensile strength, so that they are in particular very suitable for use in e.g. lightweight and strong products.

The high performance fibers may be inorganic or organic fibers. Suitable inorganic fibers are, for example, glass fibers, carbon fibers and ceramic fibers. Suitable organic fibers with such a high tensile strength are, for example, aromatic polyamide fibers (generally referred to as aramid fibers), especially poly(p-phenylene terephthalamide), liquid crystalline polymer and ladder-like polymer fibers such as polybenzimidazoles or polybenzoxazoles, esp. poly(1,4-phenylene-2,6-benzobisoxazole) (PBO), or poly(2,6-diimidazo[4,5-b-4',5'-e]pyridinylene-1,4-(2,5-dihydroxy)phenylene) (PIPD; also referred to as M5) and fibers of, for example, polyolefins as e.g. polyethylene and polypropylene, polyvinyl alcohol, and polyacrylonitrile which are highly oriented, such as obtained, for example, by a gel spinning process.

More preferably aromatic polyamide fibers, especially poly(p-phenylene terephthalamide), liquid crystalline polymer and ladder-like polymer fibers such as polybenzimidazoles or polybenzoxazoles, especially poly(1,4-phenylene-2,6-benzobisoxazole) or poly(2,6-diimidazo[4,5-b-4',5'-e] pyridinylene-1,4-(2,5-dihydroxy)phenylene) and ultrahigh molecular weight polyethylene are used as high performance fiber. These fibers give a good balance between strength and weight performance of the product. Even more preferably gel spun polyethylene is used as high performance fiber. In such case preferably linear polyethylene is used. Linear polyethylene is herein understood to mean polyethylene with less than 1 side chain per 100 C atoms, and preferably with less than 1 side chain per 300 C atoms; a side chain or branch generally containing at least 10 C atoms. Side chains may suitably be measured by FTIR on a 2 mm thick compression moulded film, by quantifying the absorption at 1375 $cm^{-1}$ using a calibration curve based on NMR measurements as mentioned in e.g. EP 0269151. The linear polyethylene may further contain up to 5 mol % of one or more other alkenes that are copolymerisable therewith, such as propene, butene, pentene, 4-methylpentene, octene. Preferably, the linear polyethylene is of high molar mass with an intrinsic viscosity (IV, as determined on solutions in decalin at 135° C.) of at least 4 dl/g; more preferably of at least 8 dl/g, most preferably of at least 10 dl/g. Such polyethylene is also referred to as ultra-high molar mass polyethylene. Intrinsic viscosity is a measure for molecular weight that can more easily be determined than actual molar mass parameters like $M_n$ and $M_w$. There are several empirical relations between IV and $M_w$, but such relation is highly dependent on molecular weight distribution. Based on the equation $M_w=5.37\times10^4\ [IV]^{1.37}$ (see EP 0504954 A1) an IV of 4 or 8 dl/g would be equivalent to $M_w$ of about 360 or 930 kg/mol, respectively.

The product of the invention comprises a plurality of interlaced yarns. By interlaced in the context of the present invention is understood that said plurality of yarns cross one with another at various locations to form a yarn construction. Said a plurality of interlaced yarns may be of any construction of yarns known in the art, e.g. woven, knitted, braided or non-woven or combinations thereof. In a preferred embodiment according to the present invention the plurality of interlaced yarns of the abrasion resistant product are braided, knitted, woven or any combination thereof. Woven interlaced yarns may include plain weave, rib, matt weave and twill weave fabrics and the like. Knitted interlaced yarns may be weft knitted, e.g. single- or double-jersey fabric or warp knitted. An example of a non-woven interlaced yarns is a felt fabric. Further examples of woven, knitted or non-woven interlaced yarns as well as the manufacturing methods thereof are described in Handbook of Technical Textile, ISBN 978-1-59124-651-0 at chapters 4, 5 and 6, the disclosure thereof being incorporated herein as reference. A description and examples of braided interlaced yarns are described in the same Handbook at Chapter 11, more in particular in paragraph 11.4.1, the disclosure thereof being incorporated herein as reference.

In a further preferred embodiment, the interlaced yarns of the product of the invention is a braided fabric; more preferably, the said braided fabric is braided to form a tape- or a band-like construction comprising filaments. It was observed that such a fabric provides further increased abrasion resistance to the product. Good examples of a tape- or a band-like construction suitable for the purpose of the invention are a webbing, a hollow tubular braid or an oblong small rope having an empty core.

The interlaced yarns of the product of the invention may also be a 3-dimensional (3D) fabric; that is the fabric contains yarns comprising fibers that run and cross each other in 3 directions. 3D fabrics are known in the art, and can be made with different textile techniques; including knitting, stitching, braiding and/or weaving. More preferably, the fabric is a 3D woven fabric, comprising warp, weft and binder strands or threads; more preferably the fabric of the invention is a 3D hollow woven fabric (in hollow tubular form). Such hollow fabric can be made with e.g. a 20 circular (or round) weaving technique or with a multi-layer flat weaving technique wherein the layers are connected at the edges to form the wall of a tubular construction. In a further preferred embodiment of the invention, the fabric is a multi-layered woven construction comprising at least 2 woven layers interconnected by binder threads, more preferably between 3 and 9 interconnected layers, optionally made in hollow tubular form. The warp, weft and binder threads can be single-, but also multi-stranded.

The interlaced yarns of the product of the invention may be coated or contain flame retardants, coatings to reduce adhesion, colorants, delusterants, and the like.

In a preferred embodiment, the product according to the invention is selected from the list comprising fabrics, ropes, nets, slings, belts.

In a yet preferred embodiment of the invention, the product comprises a sheath section and a core section, wherein the sheet section comprises the first yarn. Because of the improved abrasion resistance of the interlaced yarns of the invention, sheet sections containing said interlaced yarns may be designed with a lower thickness than known sheath sections while having the same level of abrasion resistance. In this way the total weight of the product according to the invention, e.g. a rope or a round-sling, containing said sheath section is reduced. It was also surprisingly found that the contribution of the sheath section to the stiffness of the product, in particular if the product is a rope or a round-sling, is reduced. Preferably said the sheath section is a fabric, preferably a woven or braided fabric, most preferably a hollow woven fabric.

In a yet preferred embodiment, the core section of the product according to the invention is a rope-like construction comprising the second yarn. The rope-like construction may be a single core or a multi-core rope-like construction. In a multi-core rope-like construction the rope-like construction contains a core containing a plurality of parallel or essentially parallel strands, the core being surrounded by the sheath section. In this way a product is obtained that is very strong, has a low weight and is highly resistant to abrasion.

In a highly preferred embodiment, the product of the invention is a rope or a round sling comprising an abrasion resistance sheath section comprising the first yarn. A rope or a round-sling according to the invention shows a strongly improved resistance to abrasion. Especially the resistance to external abrasion caused by cutting or sawing action of metal objects is very much improved. In case of round-slings, this is for example important in hoisting of metal coils which usually have sharp edges. In case of ropes this is for example important when the rope of the invention is used as a mooring line, in particular to moor docking ships or as a deep sea mooring line. A docking ship is under a continuous heave-pitch motion due to water waves, causing a continuous abrasion between the mooring line and the metal parts of the ship in contact thereof. The rope of the invention shows increased resistance to abrasion when used as a mooring line. In one preferred embodiment the rope has a diameter of at least 5 mm, more preferably at least 15 mm, most preferably at least 50 mm. Thinner ropes are very suitable for mooring smaller ships, like yachts etc. or for use as running rigging on boats and yachts. Thicker ropes may be hoisting lines, lines for tugging, mooring lines for ships in harbors, mooring lines for oil production installations and the like.

It was further found that a rope or a round-sling of the invention shows an increased service life being also less prone for failure. Failure, like breakage, may cause dangerous situations, for example in cases when the rope or the round-sling are used in hoisting operations. An increase in service life is important for example for mooring lines, heavy duty round-slings and the like, because once mounted such products need less maintenance and checking, decreasing therefore the overall costs coupled with such activities. An increase in service life also allows the use of ropes or round-slings of the invention in even more demanding applications replacing for example steel wires.

In case of a round-sling the fabric in the cover may be a webbing.

The rope or the round-sling of the invention is preferably entirely surrounded by the sheath section. The sheath section may have an open, net-like structure. Preferably the cover has a closed structure.

Methods

Intrinsic Viscosity (IV) is determined according to ASTM-D1601/2004 at 135° C. in decalin, the dissolution time being 16 hours, with DBPC as anti-oxidant in an amount of 2 g/l solution, by extrapolating the viscosity as measured at different concentrations to zero concentration. There are several empirical relations between IV and Mw, but such relation is highly dependent on molar mass distribution. Based on the equation $M_w=5.37*10^4\ [IV]^{1.37}$ (see EP 0504954 A1) an IV of 4.5 dl/g would be equivalent to a $M_w$ of about 422 kg/mol.

Side chains in a polyethylene or UHMWPE sample is determined by FTIR on a 2 mm thick compression molded film by quantifying the absorption at 1375 $cm^{-1}$ using a calibration curve based on NMR measurements (as in e.g. EP 0 269 151)

Tensile strength (or strength)—TS—and tensile modulus (or modulus)—TM—are defined and determined on multifilament yarns with a procedure in accordance with ASTM D 885M, using a nominal gauge length of the yarn of 500 mm, a crosshead speed of 50%/min and Instron 2714 clamps, of type Fibre Grip D5618C. On the basis of the measured stress-strain curve the modulus is determined as the gradient between 0.3 and 1% strain. For calculation of the modulus and strength, the tensile forces measured are divided by the titer; for UHMWPE yarns, values in N/tex are calculated assuming a density of polyethylene of 0.97 $g/cm^3$.

Titre of a yarn is determined by weighing 10 meters of the yarn and transform the obtained value in denier (grams per 9000 meters) or dTex (grams per 10000 meters).

Titre (T) of a UHMWPE fiber is determined using Formula I $$T = \varnothing^2 \times \frac{3.1415 \times 9 \times 0.975}{4000} \qquad \text{Formula I}$$

wherein Ø is the diameter (in micrometers) of the fiber. Ø can be determined with an optical microscope provided with a device for measuring lengths, e.g. a scale, or by scanning electron microscopy. It is preferred that for filaments, at least 100 values for the diameter thereof are determined at random locations along the filament's length and used to calculate an averaged diameter specific to said filament which is then considered as Ø. For staple fibers it is preferred that at least 10 values are used to calculate an average diameter of said staple fiber which is then considered as Ø. In case the yarn contains fibers having various titers, the Ø of the fiber is herein considered the diameter obtained by averaging the Ø of all the fibers making the yarn. In case the yarn contains a large amount of fibers, e.g. more than 100 fibers, Ø is obtained by randomly choosing 100 fibers from the yarn and averaging the Ø of these fibers.

Abrasion resistance of products was tested using a Fairlead abrasion test under dry conditions (about 50% humidity) wherein the product is subjected to a cyclic, abrasive sawing-like motion over a portion of a fairlead, the parts of the product at both sides of the fairlead making a 90°. The product is cycled over the fairlead while being kept under a tension of 20% of its breaking load; wherein the breaking load is the load applied in a standard tensile testing machine under normal conditions of e.g. temperature and humidity, under which the product breaks. It is preferred that the breaking load is calculated as an average of three measured values. The abrasion resistance was defined as the number of cycles (1 cycle=back and forward movement) after which the product failed. For example if the product is a rope, failure is considered when the rope breaks; if the product is a rope cover used to protect a rope core, failure is when the cover is abraded to the extent that the core of the rope is exposed without the necessity of complete exposure or complete rupture of the rope; if the product is a fabric, failure is considered when the fabric is abraded such that no meaningful abrasion resistance test can be carried out further.

Comparative Experiment

A product in the form of a covered rope was constructed using a core rope construction containing polyethylene SK75 yarns sold by DSM Dyneema® (NL) having a yarn tenacity of 3.51 N/tex and a yarn titer of 1760 dtex and a fiber titer of 2 den. 20 yarns of SK75 1760 dtex were bundled into a rope strand. 12 of such rope strands were braided into the core rope construction. The core rope construction had a diameter of about 10 mm, a braiding period of 64 mm, a weight length of 46.4 g/m, a force at break of 85840 N and a tenacity of 1.85 N/tex.

The core rope construction was covered by a cover construction of 24 strands each comprising 4 yarns of SK75. Said cover construction had a weight per length of 19.09 g/m.

The product was subjected to the Fairlead abrasion test under dry conditions. The cover failed after 195 cycles, i.e. it exposed the core of the rope without however complete rupturing or rope failure.

EXAMPLE

Comparative experiment A was repeated however the cover construction was made from 24 strands of an UHMWPE yarn of 6600 dtex having a yarn tenacity of 1.78 N/tex with a fiber titer of 17 den was used. The cover construction had a weight per length of 18.24 g/m.

The covered rope was subjected to the Fairlead abrasion test under conditions identical to comparative experiment. The cover failed after 289 cycles.

The invention claimed is:

1. An abrasion resistant product comprising a plurality of interlaced yarns wherein at least a first yarn has a tensile strength, having a value TS in N/tex, the first yarn containing a plurality of UHMWPE fibres with a titer per fiber, having a value T in den, and wherein a ratio T/TS is at least 6 den.tex/N.

2. The product of claim 1, wherein the plurality of UHMWPE fibres have a titer of at least 6 den.

3. The product of claim 1, wherein the first yarn has a tensile strength in the range of 0.5 to 2.2 N/te.

4. The product of claim 1, further comprising a second yarn containing a plurality of high performance fibers, wherein the second yarn is different from the first yarn.

5. The product of claim 4, wherein the second yarn has a tensile strength of at least 2.2 N/tex.

6. The product according to claim 1, wherein the plurality of interlaced yarns are braided, knitted, woven or any combination thereof.

7. The product of claim 1, wherein the product is selected from the group consisting of fabrics, ropes, nets, slings and belts.

8. The product of claim 1, further comprising a sheath section and a core section, wherein the sheath section comprises the first yarn.

9. The product of claim 8, wherein the sheath section is a fabric.

10. The product of claim 7, wherein the core section is a rope-like construction comprising the second yarn.

11. The product of claim 6, wherein the product is a rope or a round sling comprising an abrasion resistance sheath section comprising the first yarn.

12. The product of claim 1, wherein the ratio T/TS is at least 7 den.tex/N.

13. The product of claim 1, wherein the ratio T/TS is at least 8 den.tex/N.

14. The product of claim 2, wherein the titer of the plurality of UHMWPE fibres is at least 9 den.

15. The product of claim 2, wherein the titer of the plurality of UHMWPE fibres is at least 11 den.

16. The product of claim 2, wherein the titer of the plurality of UHMWPE fibres is at least 14 den.

17. The product of claim 3, wherein the tensile strength of the first yarn is in the range of 0.8 to 2.0 N/tex.

18. The product of claim 3, wherein the tensile strength of the first yarn is in the range of 1.0 to 1.8 N/tex.

19. The product of claim 5, wherein the tensile strength of the second yarn is at least 2.4 N/tex.

20. The product of claim 5, wherein the tensile strength of the second yarn is at least 2.7 N/tex.

21. The product of claim 5, wherein the tensile strength of the second yarn is at least 3.0 N/tex.

22. The product of claim 9, wherein the sheath section is a woven or braided fabric.

23. The product of claim 9, wherein the sheath section is a hollow woven fabric.

24. An abrasion resistant product comprising a plurality of interlaced yarns, wherein at least a first yarn has a tensile strength, having a value TS in N/tex which is in a range of 0.5 to 2.2 N/tex, the first yarn containing a plurality of UHMWPE fibers with a titer per fiber, having a value T in den, and wherein a ratio T/TS is at least 5 den.tex/N.

25. The product of claim 24, wherein the ratio T/TS is at least 7 den.tex/N.

26. The product of claim 24, wherein the ratio T/TS is at least 8 den.tex/N.

27. The product of claim 24, wherein the tensile strength of the first yarn is in the range of 0.8 to 2.0 N/tex.

28. The product of claim 24, wherein the tensile strength of the first yarn is in the range of 1.0 to 1.8 N/tex.

29. The product of claim 24, further comprising a second yarn containing a plurality of high performance fibers, wherein the second yarn is different from the first yarn.

30. The product of claim 29, wherein the second yarn has a tensile strength of at least 2.2 N/tex.

31. The product of claim 29, wherein the tensile strength of the second yarn is at least 2.4 N/tex.

32. The product of claim 29, wherein the tensile strength of the second yarn is at least 2.7 N/tex.

* * * * *